US007112165B1

(12) United States Patent
Forsberg

(10) Patent No.: US 7,112,165 B1
(45) Date of Patent: Sep. 26, 2006

(54) EXERCISE MACHINE

(76) Inventor: Raul Forsberg, 8250 SW. 149 Ct., Apt. 102, Miami, FL (US) 33193

( * ) Notice: Subject to any disclaimer, the term of this patent is extended or adjusted under 35 U.S.C. 154(b) by 35 days.

(21) Appl. No.: 11/087,191

(22) Filed: Mar. 24, 2005

(51) Int. Cl.
*A63B 21/22* (2006.01)

(52) U.S. Cl. ..... 482/110; 482/93; 482/131

(58) Field of Classification Search ..... 482/72, 482/92, 93, 110, 131, 132; D21/674
See application file for complete search history.

(56) References Cited

U.S. PATENT DOCUMENTS

| | | | | |
|---|---|---|---|---|
| 181,836 | A * | 9/1876 | Graham | 482/110 |
| 247,532 | A * | 9/1881 | Bennett | 482/110 |
| 764,118 | A * | 7/1904 | Duffner | 482/110 |
| 770,994 | A * | 9/1904 | White | 482/110 |
| 786,552 | A * | 4/1905 | Duffner | 607/78 |
| 1,006,470 | A * | 10/1911 | Duffner | 607/78 |
| 1,783,376 | A * | 12/1930 | Duff | 482/110 |
| 1,869,673 | A * | 8/1932 | Duff | 482/110 |
| 1,916,660 | A * | 7/1933 | Duff | 482/110 |
| D231,242 | S * | 4/1974 | Herrmann et al. | D21/674 |
| 4,880,224 | A | 11/1989 | Jonas et al. | 482/72 |
| 5,242,351 | A * | 9/1993 | Berg et al. | 482/110 |
| 5,645,514 | A | 7/1997 | Chen | 482/72 |
| 6,283,899 | B1 * | 9/2001 | Charnitski | 482/110 |
| 6,761,670 | B1 | 7/2004 | Liou | |
| 6,929,587 | B1 * | 8/2005 | Charnitski | 482/110 |

FOREIGN PATENT DOCUMENTS

DE 3814573 A1 * 12/1988

* cited by examiner

*Primary Examiner*—Jerome Donnelly
*Assistant Examiner*—Victor K. Hwang
(74) *Attorney, Agent, or Firm*—Albert Bordas

(57) ABSTRACT

An exercise machine comprising a weighted spool assembly having a shaft that freely rotates upon bearings. To accelerate the weighted spool assembly, a user applies a pulling force to a strap assembly. With the strap assembly in a coiled position, the user applies the pulling force causing the weighted spool assembly to rotate in a first direction, uncoiling the strap assembly, until the length of the strap assembly is exhausted. Once exhausted, the weighted spool assembly continues to rotate in the first direction causing the strap assembly to coil upon it. While the strap assembly is coiling and to decelerate, the user then applies a resistance force. Once the strap assembly is coiled again, the user reapplies the pulling force causing the weighted spool assembly to rotate in a second direction, uncoiling the strap assembly, until the length of the strap assembly is again exhausted.

4 Claims, 4 Drawing Sheets

10
80
60
86
74
84
74
64
62
82
42
86
30
22
28
26
24
22
20
24

10
80
60
86
74
84
74
64
62
82
42
86
30
22
28
26
24
22
20
24

EXERCISE MACHINE

BACKGROUND OF THE INVENTION

1. Field of the Invention

The present invention relates to exercise equipment, and more particularly, to exercise machines having a weighted spool assembly.

2. Description of the Related Art

Several designs for exercise machines have been designed in the past. None of them, however, includes a weighted spool assembly having a shaft that freely rotates upon bearings. Whereby, to accelerate the weighted spool assembly, a user applies a pulling force to a strap assembly that is fixed at a distal end to the weighted spool assembly. With the strap assembly in a coiled position, the user applies the pulling force causing the weighted spool assembly to rotate in a first direction, uncoiling the strap assembly, until the length of the strap assembly is exhausted. Once exhausted, the weighted spool assembly continues to rotate in the first direction causing the strap assembly to coil upon it. While the strap assembly is coiling and to decelerate, the user then applies a resistance force. Once the strap assembly is coiled again, the user reapplies the pulling force causing the weighted spool assembly to rotate in a second direction, uncoiling the strap assembly, until the length of the strap assembly is again exhausted.

Applicant believes that the closest reference corresponds to U.S. Pat. No. 6,761,670 issued to Liou for Exerciser having an improved resistive device, on Jul. 13, 2004. However, it differs from the present invention because Liou teaches an exerciser including a wheel and a housing rotatably engaged on a shaft, a bearing disposed between the wheel and the housing for allowing the wheel to be rotated in an active direction by the housing and to be prevented from rotating in a reverse direction by the housing. A strap may be used to rotate the housing in the active direction. A spring may bias the housing to rotate in the reverse direction, and will not bias the wheel when the spring biases the housing to rotate backward in the reverse direction, such that the spring will not be damaged by the wheel.

Applicant believes that another close reference corresponds to U.S. Pat. No. 5,645,514 issued to Chen for Pulling type exerciser, on Jul. 8, 1997. However, it differs from the present invention because Chen teaches an exerciser including a base tube and an extension slidably engaged in the base tube. The extension includes a front end movable outward of the base tube. A frame is secured to the front end of the extension for supporting a shaft and a pulley. One or more wheels are secured on the shaft for facilitating the movement of the extension relative to the base tube. A resilient hand is received in the base tube and the extension and has a front end engaged over the pulley. A handle is secured to the front end of the resilient band for exercising the upper muscle.

Applicant believes that another close reference corresponds to U.S. Pat. No. 4,880,224 issued to Jonas, et al. for Rowing machine, on Nov. 14, 1989. However, it differs from the present invention because Jonas, et al. teaches a frame member having a seat mounted thereon, the seat being movable therealong. The frame member also carries feet rests. A shaft is mounted across the frame member at one end thereof, and a flywheel is mounted on the shaft. A planetary gear system having a rotatable carrier, pinion gears mounted in the carrier, a stationary ring gear and a central gear is mounted on the shaft for rotatably driving the flywheel. The central gear is mounted on the shaft for rotation therewith. A spool is mounted on the carrier for rotation therewith. A cable is wound around the spool for providing rotary motion to the spool when the cable is pulled by an exerciser during the rowing stroke. Thus, the rotary motion of the spool is transferred to the flywheel through the planetary gear system and the shaft in a speed increasing mode.

Other patents describing the closest subject matter provide for a number of more or less complicated features that fail to solve the problem in an efficient and economical way. None of these patents suggest the novel features of the present invention.

SUMMARY OF THE INVENTION

The instant invention operates on the laws of potential and kinetic energy, wherein kinetic energy is the energy of motion. Kinetic energy is measured by how much is work done to put an object in motion or to rest. KINETIC ENERGY=½ (MASS)(VELOCITY)$^2$. Potential energy is energy due to position or stored energy. Potential energy is also called gravitational potential energy. POTENTIAL ENERGY=(WEIGHT) (HEIGHT). Furthermore, the instant invention does not comprise springs, brakes, or any other similar elements that impedes the rotation of the weighted spool assembly. The instant invention allows the user to regulate their exercising effort to his or her ability, regardless of whether the user is a professional athlete or a user in a conditioning or rehabilitative status.

More specifically, the instant invention is an exercise machine comprising a frame assembly having elevation blocks. A weighted spool assembly comprises a shaft having predetermined weights fixedly secure thereon. The shaft is rotatably mounted to shaft braces having bearings, allowing the shaft and the predetermined weights to freely rotate upon its axis. The shaft braces are removably secured to the elevation blocks. The weighted spool assembly further comprises a retainer wall mount having a channel and a strap bar. A strap assembly comprises a handle having handle frame. The strap may be adjustably secured onto the handle frame by a buckle. The strap is fixed at a distal end below the strap bar with a screw. Exercise means comprises accelerating the weighted spool assembly by applying a pulling force at the handle when the strap is in a coiled position, causing the weighted spool assembly to rotate in a first direction while uncoiling the strap until the length of strap is exhausted. And once exhausted, the weighted spool assembly continues to rotate in the first direction, causing the strap to progress to the coiled position upon the retainer wall mount. Decelerating the weighted spool assembly is accomplished by applying a resistance force at the handle while the strap is coiling, and reaccelerating is accomplished by reapplying the pulling force at the handle when the strap is in the coiled position, causing the weighted spool assembly to rotate in a second direction while the uncoiling the strap until the length of the strap is again exhausted, and repeated until desired.

The shaft braces comprises lubrication fittings to allow for lubrication matter to be introduced to the bearings. The frame assembly serves as a base and is laid upon a relatively flat surface having non-sliding characteristics. The frame assembly comprises first and second elongated members having ends, parallel and equally spaced apart from each other by elongated cross members. Mounted and secured upon the elongated cross members are the elevation blocks.

It is therefore one of the main objects of the present invention to provide an exercise machine comprising a weighted spool assembly having a shaft that freely rotates upon bearings.

It is another object of this invention to provide an exercise machine that accelerates and decelerates the weighted spool assembly when a user applies a pulling force and a resistance force respectively to a strap assembly that is fixed at a distal end to the weighted spool assembly.

It is still another object of the present invention to provide an exercise machine having a weighted spool assembly that rotates in a first and second direction.

It is yet another object of this invention to provide such a device that is inexpensive to manufacture and maintain while retaining its effectiveness.

Further objects of the invention will be brought out in the following part of the specification, wherein detailed description is for the purpose of fully disclosing the invention without placing limitations thereon.

BRIEF DESCRIPTION OF THE DRAWINGS

With the above and other related objects in view, the invention consists in the details of construction and combination of parts as will be more fully understood from the following description, when read in conjunction with the accompanying drawings in which.

DETAILED DESCRIPTION OF THE PREFERRED EMBODIMENT

Figure 1:
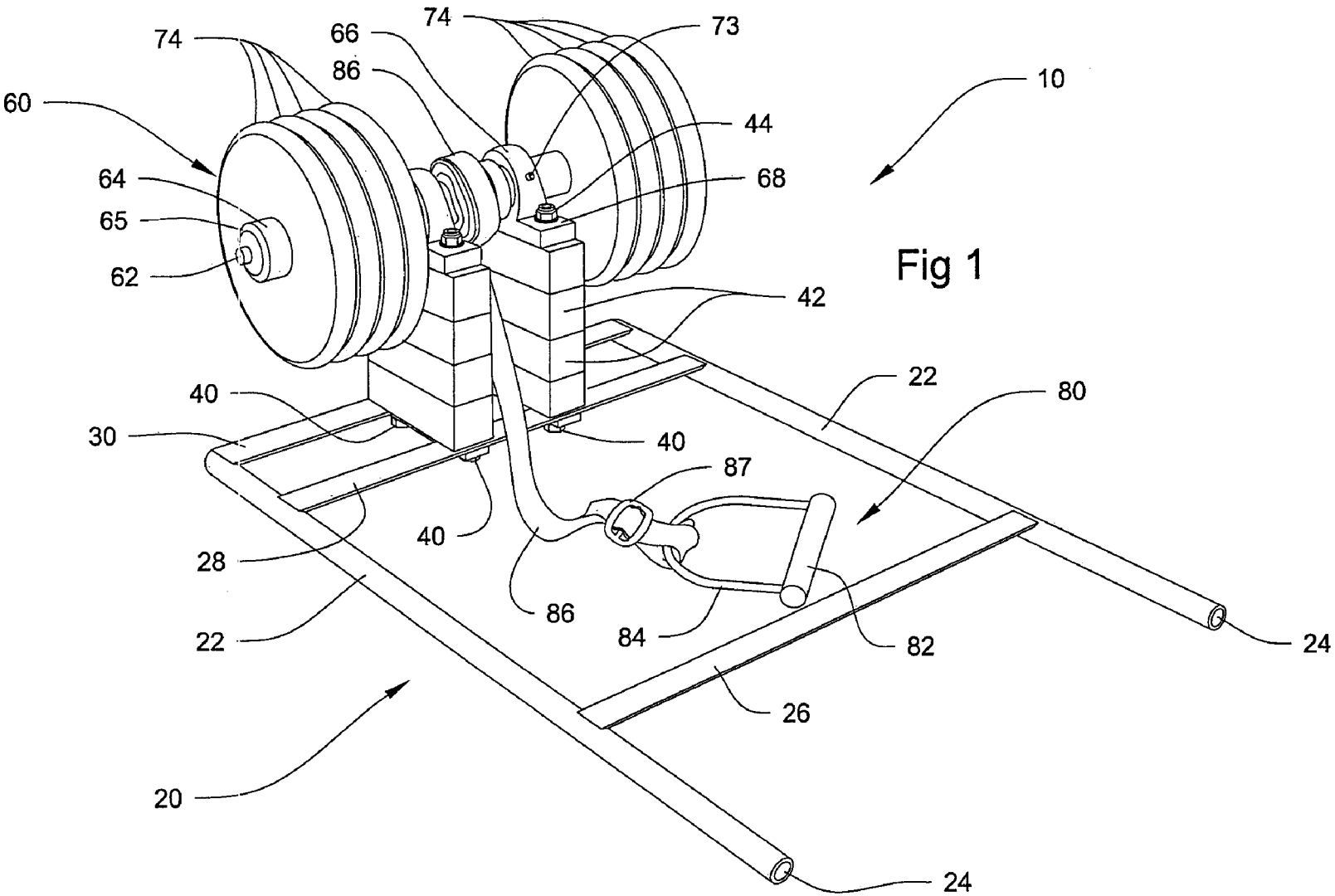
FIG. 1 represents a perspective view of the instant invention.

Referring now to the drawings, where the present invention is generally referred to with numeral 10, it can be observed that it basically includes frame assembly 20, weighted spool assembly 60, and strap assembly 80.

As seen in FIG. 1, frame assembly 20 comprises elongated members 22 having ends 24, parallel and equally spaced apart from each other by elongated cross members 26, 28, and 30. Frame assembly 20 serves as a base, and in the preferred embodiment, is laid upon a relatively flat surface having a rug, mat, or other surface having non-sliding characteristics. Mounted upon elongated cross members 28 and 30 are elevation blocks 42. Elevation blocks 42 are secured onto elongated cross members 28 and 30 with bolts 40 and their respective nuts 44. In the preferred embodiment, elevation blocks 42 have sufficient height to allow weights 74 to freely rotate.

Figure 2:
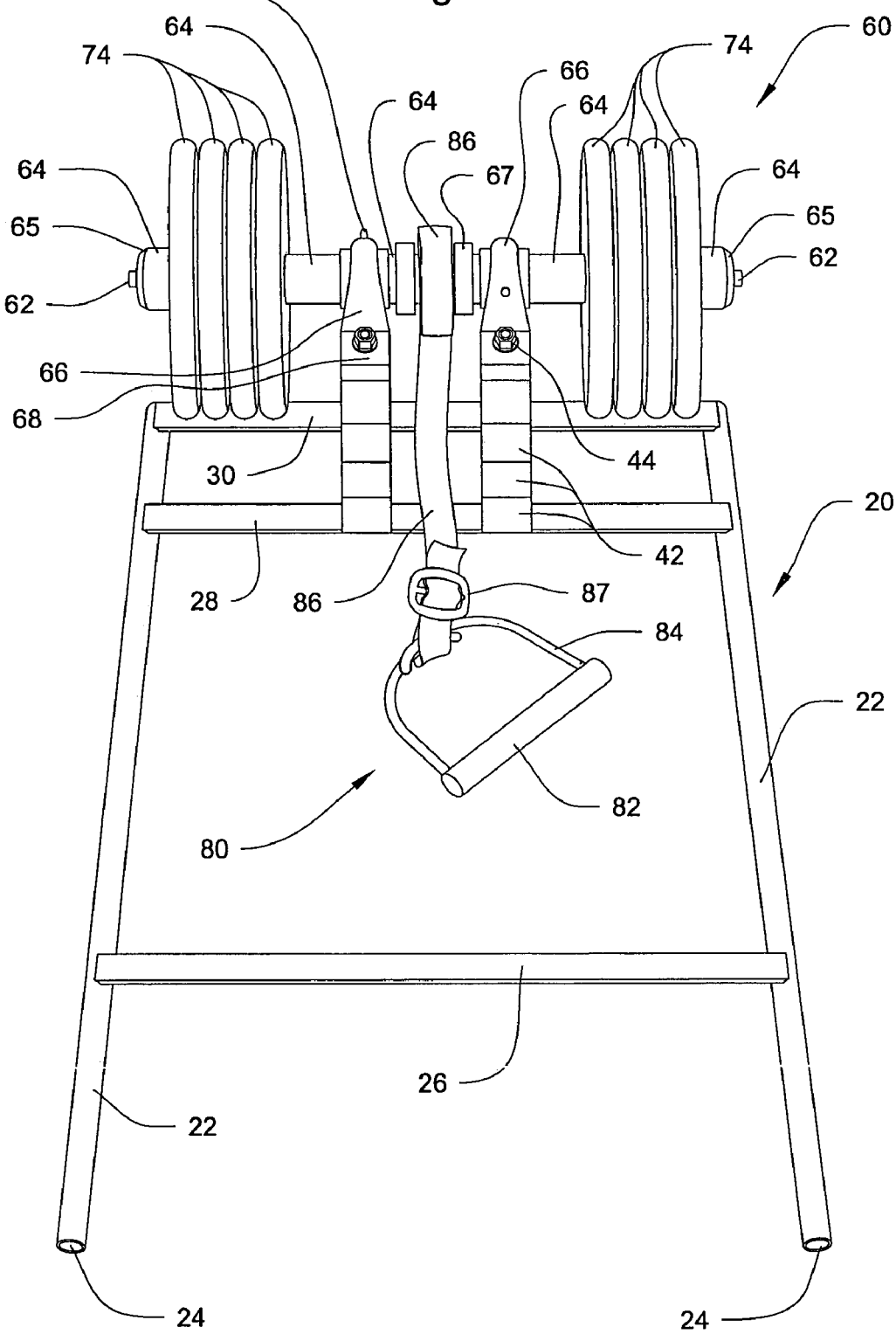
FIG. 2 represents a front view of the instant invention.

As better seen in FIG. 2, weighted spool assembly 60 comprises shaft 64. At its distal ends, shaft 64 has angled faces 65 and ends 62. Fixedly secure and centrally disposed upon shaft 64 is retainer wall mount 67. In addition, shaft 64 also comprises predetermined weights 74. It is noted that shaft 64, retainer wall mount 67, and predetermined weights 74 all rotate together, since retainer wall mount 67 and predetermined weights 74 are fixed upon shaft 64. Shaft 64 is rotatably mounted to shaft braces 66. It is noted that shaft braces 66 have bearings, not seen, that allow shaft 64 to freely rotate upon its axis. Shaft braces 66 are removably secured at faces 68 to elevation blocks 42 with bolts 40 and their respective nuts 44. Shaft braces 66 comprise lubrication fittings 73 to allow for lubrication matter such as grease, to be introduced to the bearings. Strap assembly 80 comprises handle 82 having handle frame 84. Strap 86 may be adjustably secured onto handle frame 84 by buckle 87.

Figure 3A:
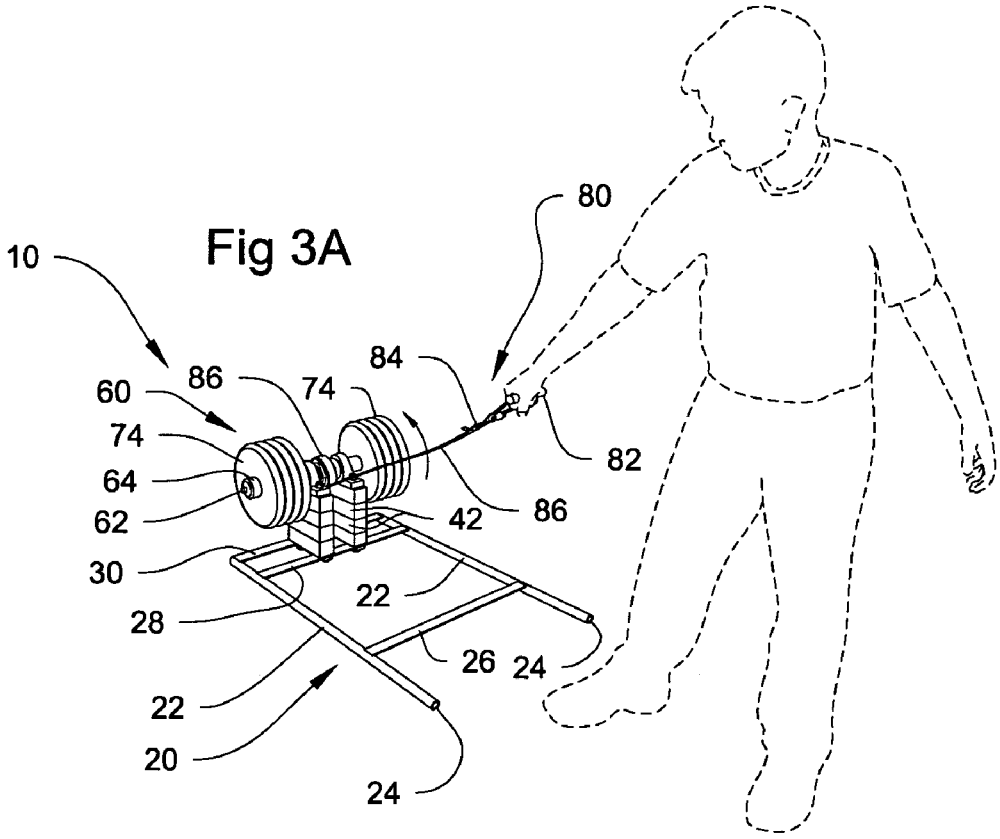
FIG. 3A illustrates perspective view of a user applying a pulling force at a handle of the strap assembly, causing the weighted spool assembly and shaft to rotate in a first direction.

As seen in FIG. 3A, in operation, instant invention 10 comprises weighted spool assembly 60 having shaft 64 that freely rotates upon bearings, not seen. To accelerate weighted spool assembly 60, the user applies a pulling force at handle 82 of strap assembly 80 that is fixed at a distal end below strap bar 70 with screw 72, seen in FIG. 3B. With strap 86 of strap assembly 80 in a coiled position, the user applies the pulling force causing weighted spool assembly 60 to rotate in a first direction, uncoiling strap 86, until the length of strap 86 is exhausted.

Figure 3C:
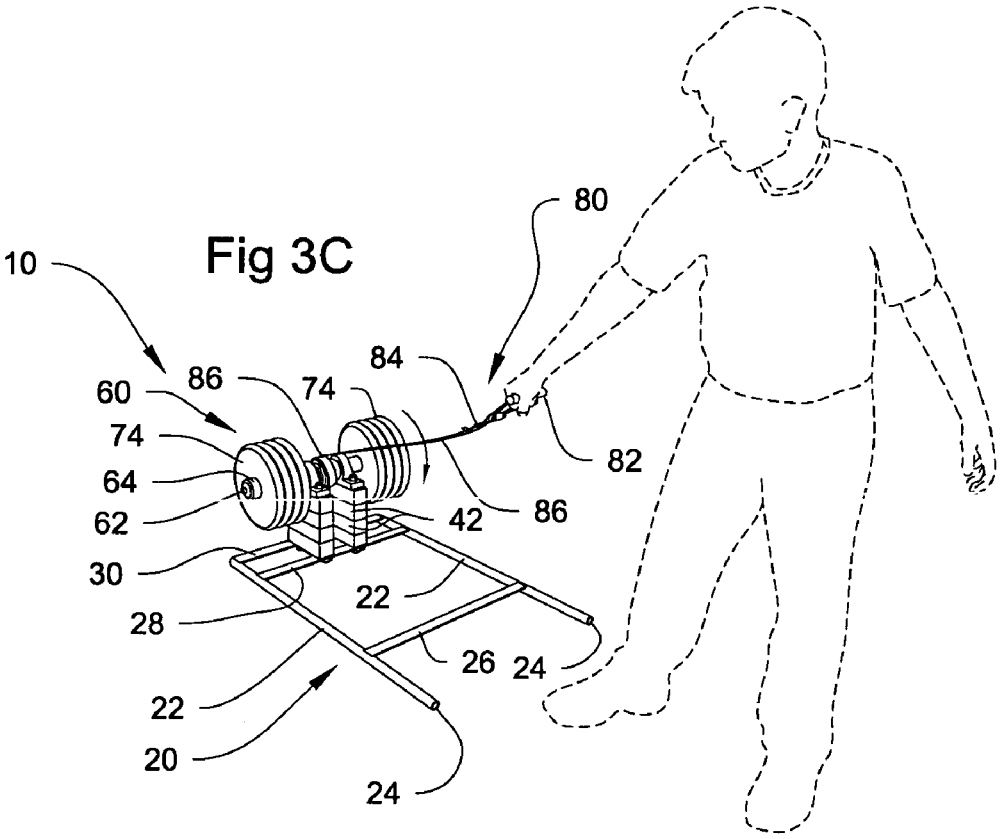
FIG. 3C illustrates perspective view of a user reapplying a pulling force at the handle of the strap assembly, causing the weighted spool assembly and shaft to rotate in a second direction.
Figure 3B:
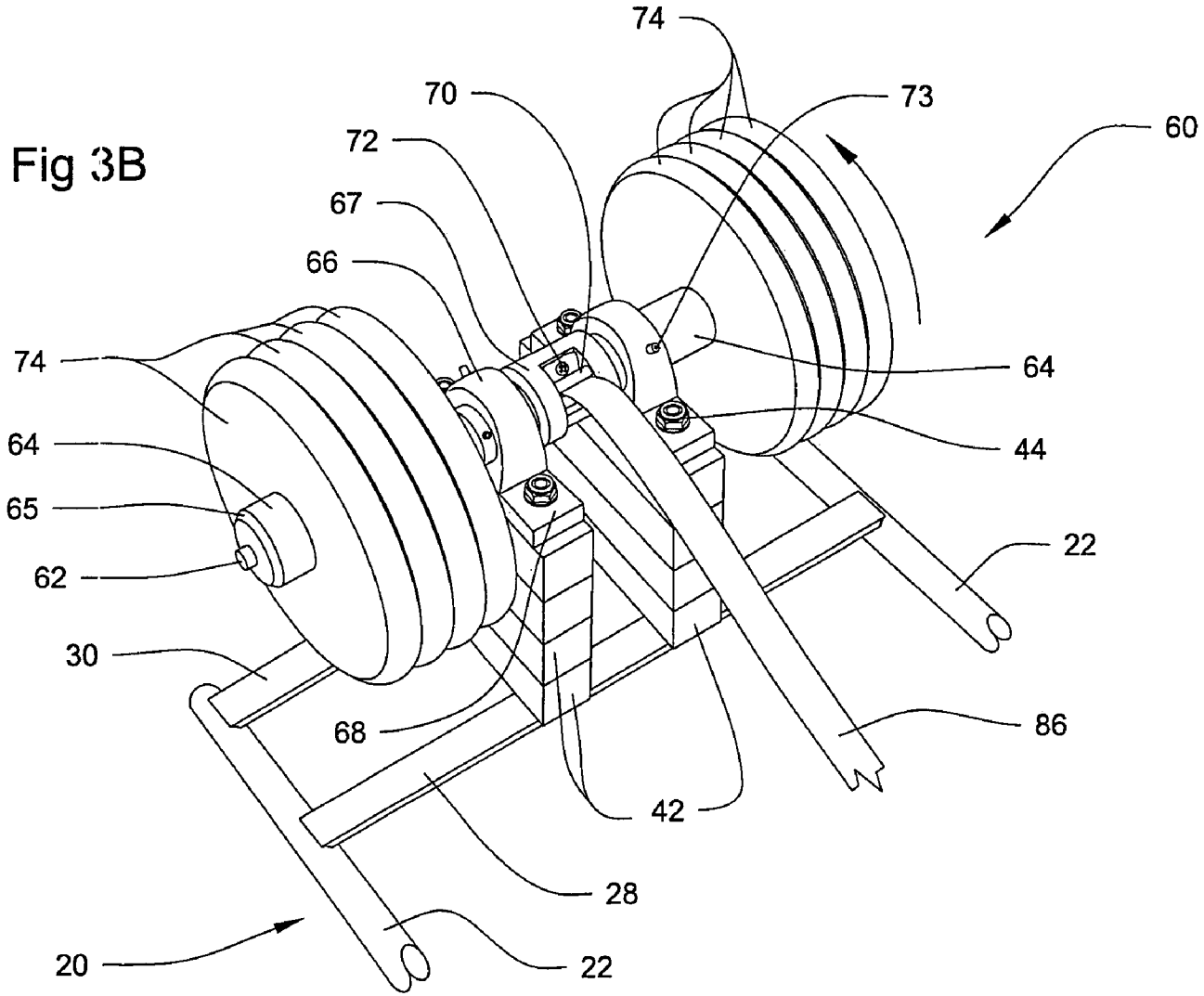
FIG. 3B illustrates a close-up view of the weighted spool assembly having exhausted the total strap length of the strap assembly and the weighted spool assembly and shaft, continuing rotation in the first direction.

As seen in FIG. 3B, once exhausted, weighted spool assembly 60 continues to rotate in the same first direction, causing strap 86 to coil upon it. While strap 86 is coiling and to decelerate, the user then applies a resistance force. As best seen in this illustration, shaft 64 comprises retainer wall mount 67 to contain strap 86 as it coils and uncoils upon it. Retainer wall mount 67 comprises a channel to secure strap 86 below strap bar 70 with screw 72.

As seen in FIG. 3C, once strap 86 is coiled again, the user reapplies the pulling force causing weighted spool assembly 60 to rotate in a second direction, uncoiling strap 86, until the length of the strap 86 is again exhausted. This exercise is repeated until desired by the user.

The instant invention comprising the weighted spool assembly 60 may be applied to any variety of exercise equipment where the user applies a pulling and resistance force.

The foregoing description conveys the best understanding of the objectives and advantages of the present invention. Different embodiments may be made of the inventive concept of this invention. It is to be understood that all matter disclosed herein is to be interpreted merely as illustrative, and not in a limiting sense.

What is claimed is:

1. An exercise machine, comprising:

A) a frame assembly 20 having elevation blocks 42;

B) a weighted spool assembly 60 comprising a shaft 64, said shaft 64 having predetermined weights 74 fixedly secure thereon, said shaft 64 is rotatably mounted to shaft braces 66 having bearings, allowing said shaft 64 and said predetermined weights 74 to freely rotate upon its axis, said shaft braces 66 are removably secured to said elevation blocks 42, said weighted spool assembly 60 further comprising a retainer wall mount 67 having a channel and a strap bar 70;

C) a strap assembly 80 comprising a handle 82 having handle frame 84, a strap 86 may be adjustably secured onto said handle frame 84 by a buckle 87, said strap 86 is fixed at a distal end below said strap bar 70 with a screw 72; and D) exercise means comprising accelerating said weighted spool assembly 60 by applying a pulling force at said handle 82 when said strap 86 is in a coiled position, causing said weighted spool assembly 60 to rotate in a first direction while uncoiling said strap 86 until the length of strap 86 is exhausted, and once said exhausted, said weighted spool assembly 60 continues to rotate in said first direction causing said strap 86 to progress to said coiled position upon said retainer wall mount 67, and comprising decelerating said weighted spool assembly 60 by applying a resistance force at said handle 82 while said strap 86 is coiling, and reaccelerating said weighted spool assembly 60 by reapplying said pulling force at said handle 82 when said strap 86 is in said coiled position, causing said weighted spool assembly 60 to rotate in a second direction while said uncoiling said strap 86 until said length of said strap 86 is again said exhausted, and repeated until desired.

2. The exercise machine according to claim 1, further characterized in that said shaft braces 66 comprise lubrication fittings 73 to allow for lubrication matter to be introduced to said bearings.

3. The exercise machine according to claim 2, further characterized in that said frame assembly 20 serves as a base and is laid upon a relatively flat surface having non-sliding characteristics.

4. The exercise machine according to claim 3, further characterized in that said frame assembly 20 comprises first and second elongated members 22 having ends 24, parallel and equally spaced apart from each other by elongated cross members 26; 28; and 30, mounted and secured upon said elongated cross members 28 and 30 said elevation blocks 42.

* * * * *